US006840073B2

(12) United States Patent
Huang et al.

(10) Patent No.: US 6,840,073 B2
(45) Date of Patent: Jan. 11, 2005

(54) LID DEVICE OF DOUBLE-SIDED AUXILIARY LOCK

(75) Inventors: Chao-Ming Huang, Kaohsiung Hsien (TW); Chung-Chi Wu, Kaohsiung Hsien (TW)

(73) Assignee: Taiwan Fu Hsing Industrial Co., Ltd., Koahsiung Hsien (TW)

( * ) Notice: Subject to any disclaimer, the term of this patent is extended or adjusted under 35 U.S.C. 154(b) by 0 days.

(21) Appl. No.: 10/610,568

(22) Filed: Jul. 2, 2003

(65) Prior Publication Data

US 2004/0244446 A1 Dec. 9, 2004

(51) Int. Cl.[7] ..... E05B 9/04

(52) U.S. Cl. ..... 70/370; 70/372; 70/375; 70/381; 70/449; 70/452; 70/DIG. 57

(58) Field of Search ..... 70/367–373, 375, 70/381, 232, 466, 447–449, 417, 455, 451, 452, 423, 424, 427, 428, 431, 453, 454, DIG. 40, DIG. 56, DIG. 57, DIG. 60

(56) References Cited

U.S. PATENT DOCUMENTS

| | | | | | |
|---|---|---|---|---|---|
| 1,674,737 | A | * | 6/1928 | Page | 70/373 |
| 1,877,404 | A | * | 9/1932 | Jacobi | 70/367 |
| 3,520,161 | A | * | 7/1970 | Jacobi | 70/387 |
| 4,170,120 | A | * | 10/1979 | Feltman et al. | 70/431 |
| 4,423,611 | A | * | 1/1984 | Neyret et al. | 70/455 |
| 4,444,033 | A | * | 4/1984 | Deckert | 70/493 |
| 5,216,910 | A | * | 6/1993 | Lin | 70/370 |
| 5,249,444 | A | * | 10/1993 | Dancs | 70/380 |
| 5,351,513 | A | * | 10/1994 | Ellis | 70/370 |
| 5,713,231 | A | * | 2/1998 | Shen | 70/370 |
| 5,722,273 | A | * | 3/1998 | Lin et al. | 70/370 |
| 6,397,647 | B1 | * | 6/2002 | Kuo | 70/423 |
| 6,481,250 | B1 | * | 11/2002 | Kuo | 70/49 |

FOREIGN PATENT DOCUMENTS

| | | | | |
|---|---|---|---|---|
| CH | 177900 | * | 9/1935 | 70/452 |
| DE | 401571 | * | 9/1924 | 70/370 |
| DE | 2208655 | * | 8/1973 | 70/451 |
| GB | 425274 | * | 3/1935 | 70/417 |

* cited by examiner

*Primary Examiner*—Lloyd A. Gall
(74) *Attorney, Agent, or Firm*—Bacon & Thomas

(57) ABSTRACT

A lid device of a double-sided auxiliary lock, the lid device includes an inner annular wall, an outer annular wall and engaging portions. The engaging portions are equi-spaced on the outer annular wall. A double-sided auxiliary lock has an interior auxiliary lock assembly and positioning elements. The interior auxiliary lock assembly has a locking core provided with an outer annular recess, holes, an inner annular groove and a keyway. The inner annular groove is communicated to the keyway. The inner annular wall is corresponding to the inner annular groove of the locking core. The engaging portions are engaged to the outer annular recess of the locking core. The lid can cover the positioning elements. The lid has at least one engaging portion to be positioned correspondingly to the keyway. By detaching the cover, the disengagement of the engaging portions from the outer annular recess can be operated through the keyway.

5 Claims, 7 Drawing Sheets

LID DEVICE OF DOUBLE-SIDED AUXILIARY LOCK

FIELD OF THE INVENTION

The present invention relates to lock devices, and particularly to a lid device of a double-sided auxiliary lock; wherein a lid covers on a locking core; and the lid has a plurality of engaging portions for locking the locking core.

BACKGROUND OF THE INVENTION

The prior art double-sided auxiliary lock includes a locking core, a reinforcing plate and a surface lid. The locking core is installed with a plurality of screw holes. The locking core is combined with an auxiliary lock at an inner side by a plurality of positioning elements passing through the screw holes. The reinforcing plate has a via hole to which the surface lid is attached. The surface lid is formed with a post which can extend through the via hole of the reinforcing plate. The surface lid is disposed at an outer side of the locking core.

In above mentioned prior art, the locking core has the effect of preventing the double-sided auxiliary lock from being destroyed, but in a surface of the auxiliary lock, the positioning elements assembled in an inner side of the double-sided auxiliary lock is exposed. Thereby, the positioning elements are still possibly destroyed. Moreover, the exposed positioning elements will result in a poor appearance of the double-sided auxiliary lock. Thus, there is an eager demand for a novel design which can improve the prior art defects.

SUMMARY OF THE INVENTION

Accordingly, the primary object of the present invention is to provide a lid device of a double-sided auxiliary lock, wherein a lid covers a locking core of an interior auxiliary lock assembly. Since the locking core is formed with a plurality of positioning elements, the lid can cover the positioning elements of the locking core so that the present invention has a function of destroy-proof.

Another object of the present invention is to provide a lid device of a double-sided auxiliary lock, wherein a periphery of the lid is arranged with a plurality of engaging portions. A locking core is formed with an inner annular groove and a keyway. In assembly, at least one engaging portion of the lid is arranged corresponding to the keyway. Thereby, when detaching the cover, the engagement of the engaging portions and the outer annular recess can be operated through the keyway. Thereby, the present invention can be assembled easily.

To achieve above objects, the present invention provides a lid device of a double-sided auxiliary lock which comprises an inner annular wall, an outer annular wall and a plurality of engaging portions. The engaging portions are equi-spaced on the outer annular wall. The double-sided auxiliary lock has an interior auxiliary lock assembly and a plurality of positioning elements. The interior auxiliary lock assembly has a locking core provided with an outer annular recess, a plurality of via holes, an inner annular groove, and a keyway. The inner annular groove is communicated to the keyway. The inner annular wall is corresponding to the inner annular groove of the locking core. The engaging portions are engaged to the outer annular recess of the locking core. Thereby, the lid can cover the positioning elements. In assembly, the lid has at least one engaging portion to be positioned correspondingly to the keyway. Thereby, when detaching the cover, the disengagement of the engaging portions from the outer annular recess can be operated through the keyway.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
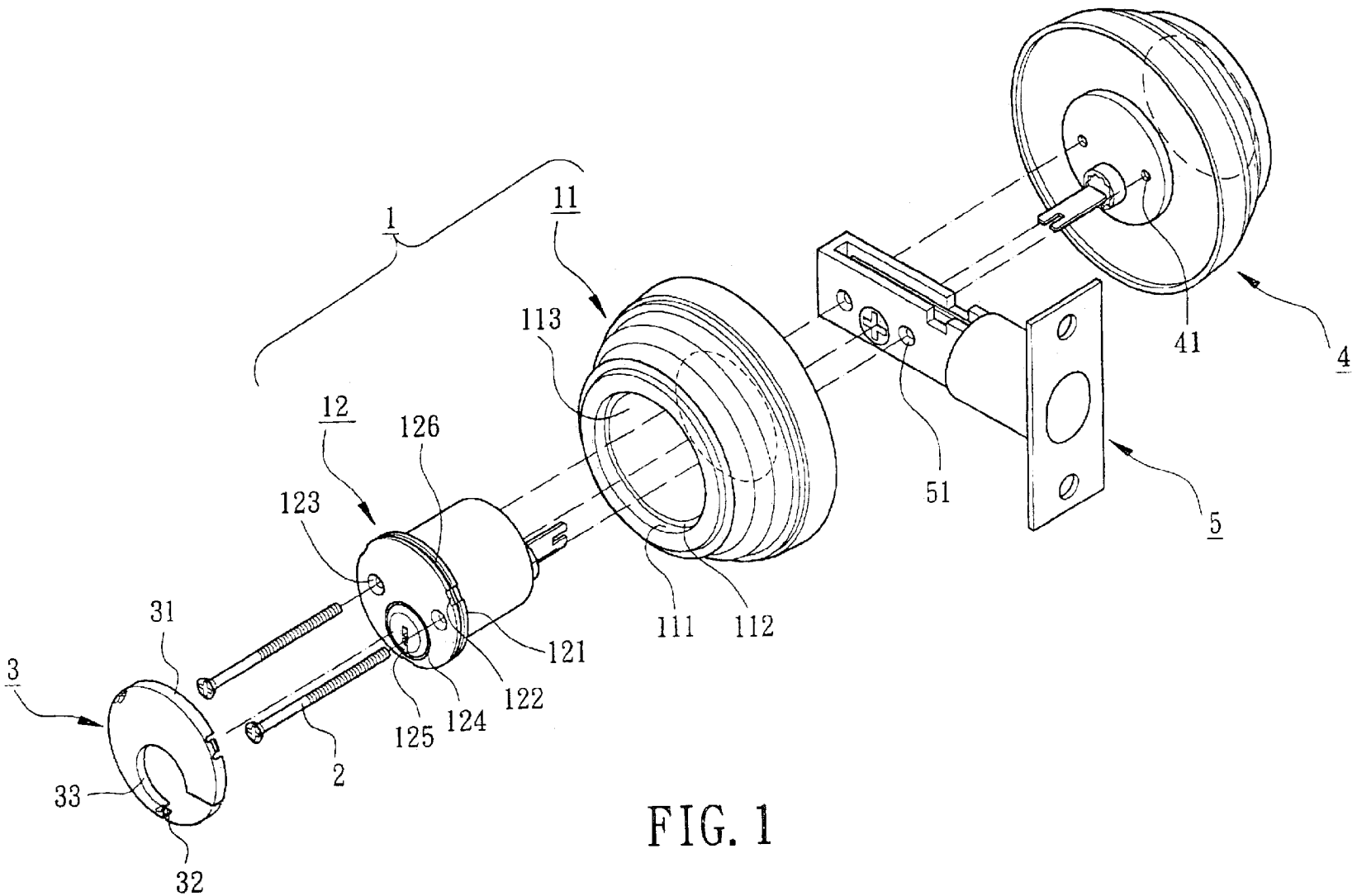
FIG. 1 shows the exploded perspective view of the lid device of a double-sided auxiliary lock according to the first preferred embodiment of the present invention.
Figure 2:
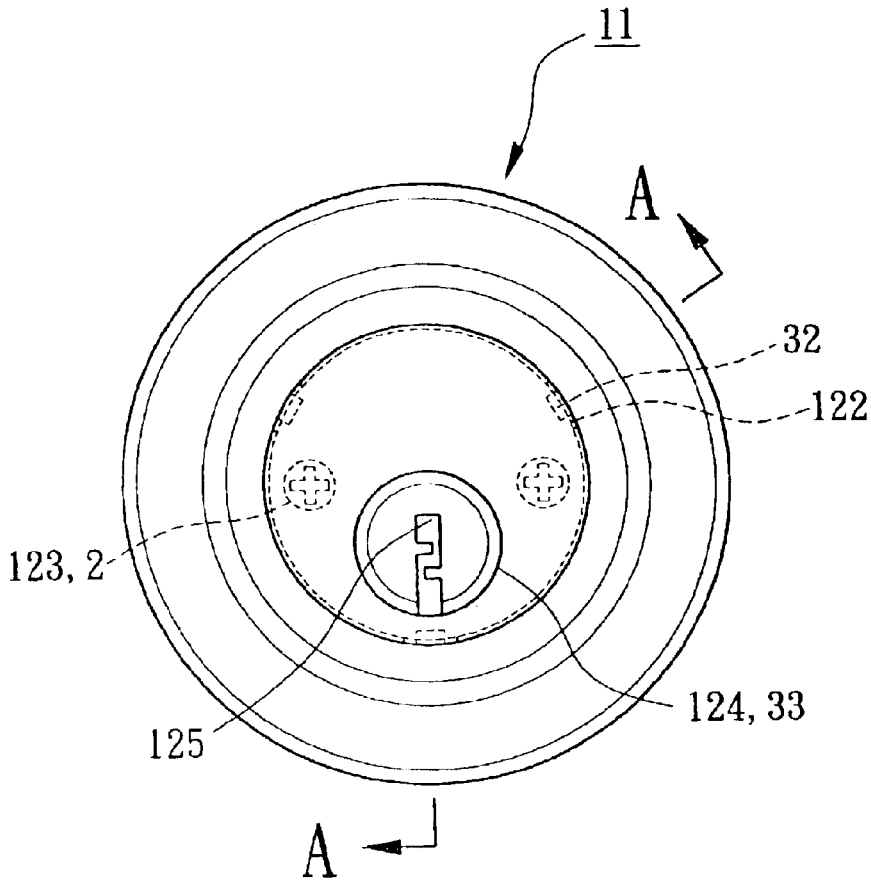
FIG. 2 shows the front view of the lid device of a double-sided auxiliary lock of the first preferred embodiment of the present invention.
Figure 3:
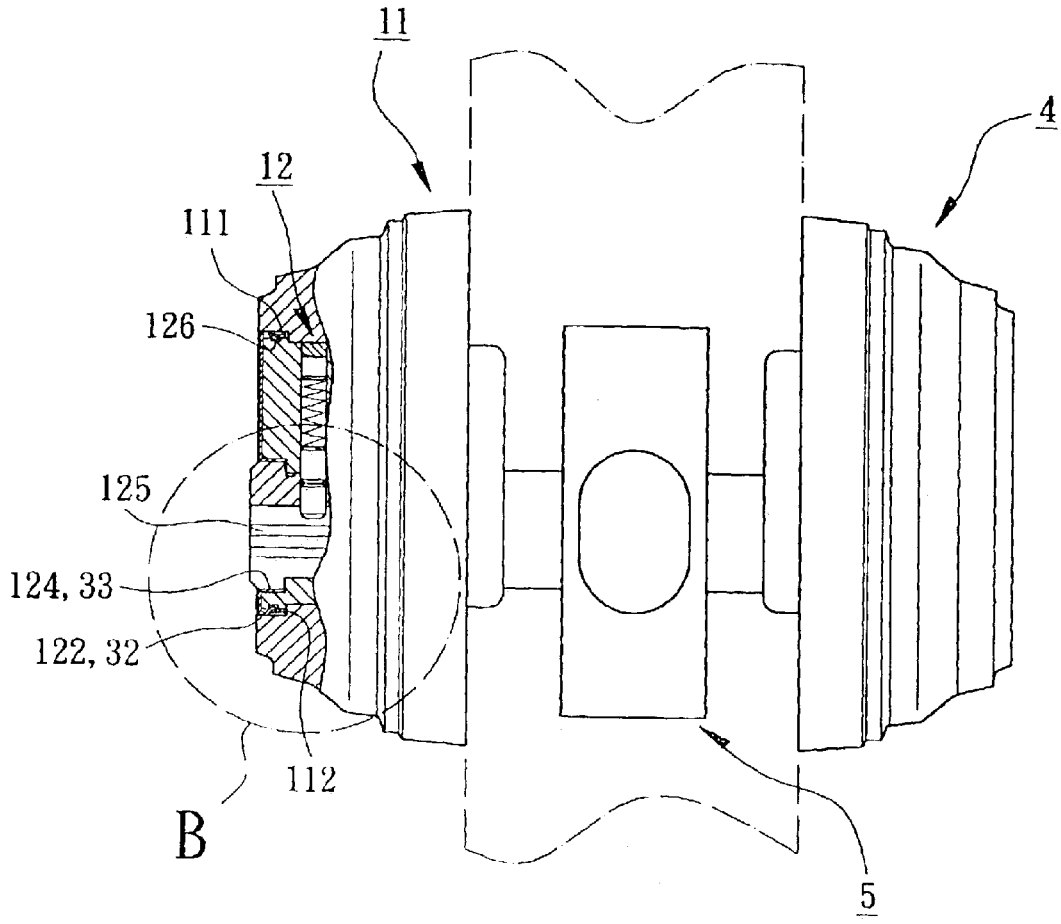
FIG. 3 is a cross sectional view showing the casing in the first preferred embodiment of the present invention along a line A—A of FIG. 2.
Figure 4:
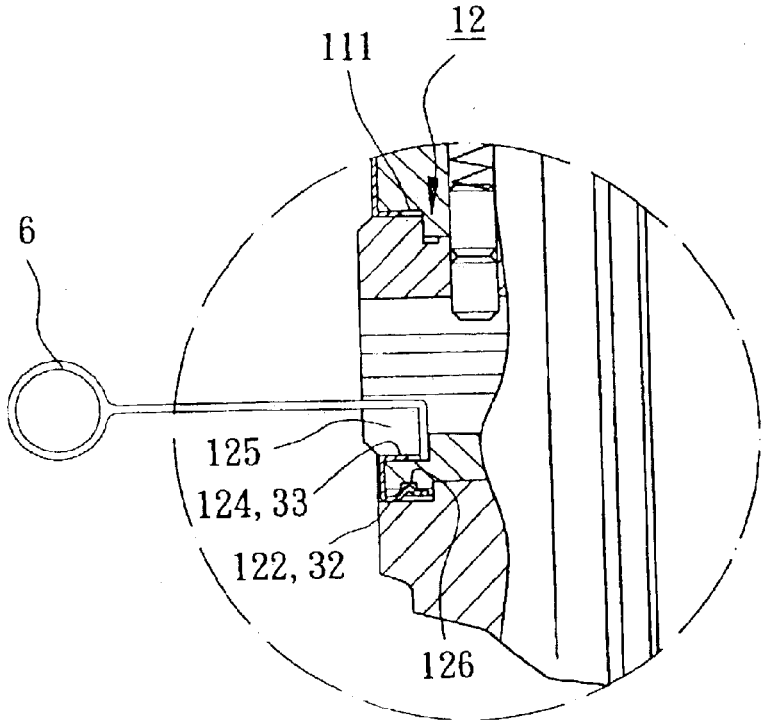
FIG. 4 is a partial enlarged view showing the detachment of the lid device of a double-sided auxiliary lock in the first preferred embodiment of the present invention.
Figure 5:
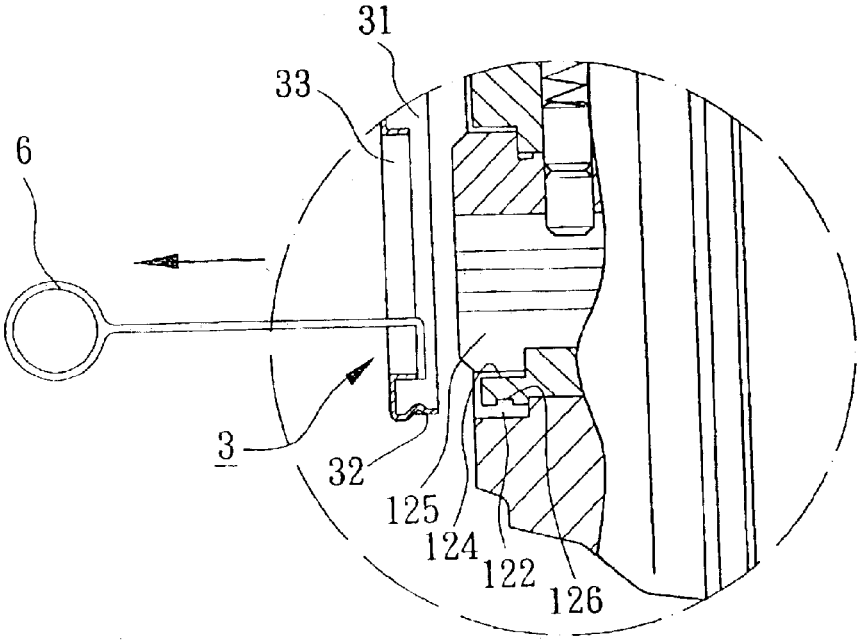
FIG. 5 is a partial enlarged view showing that the lid device of a double-sided auxiliary lock in the first preferred embodiment of the present invention has been detached.
Figure 6:
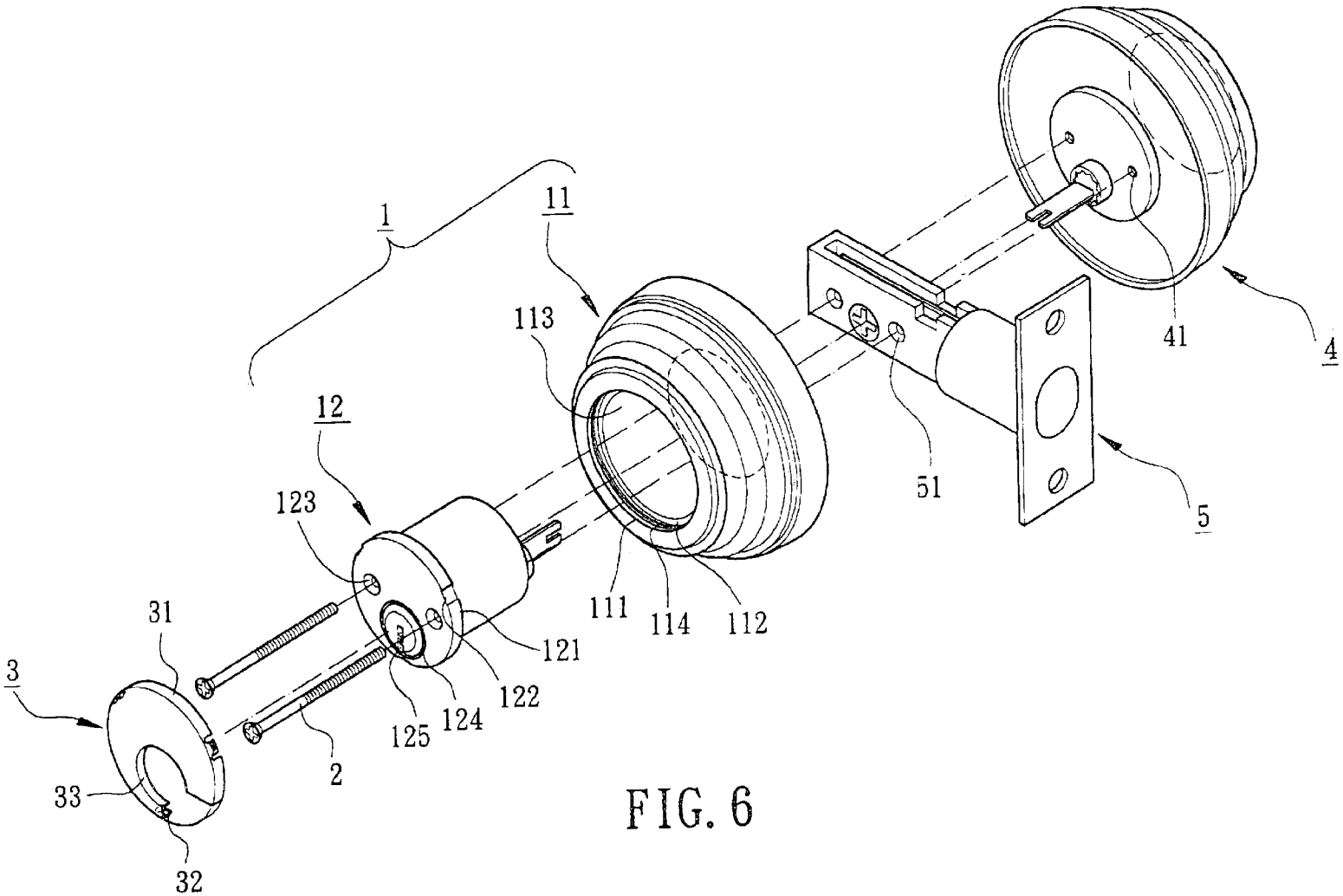
FIG. 6 shows the exploded perspective view of the lid device of a double-sided auxiliary lock in the second preferred embodiment of the present invention.
Figure 7:
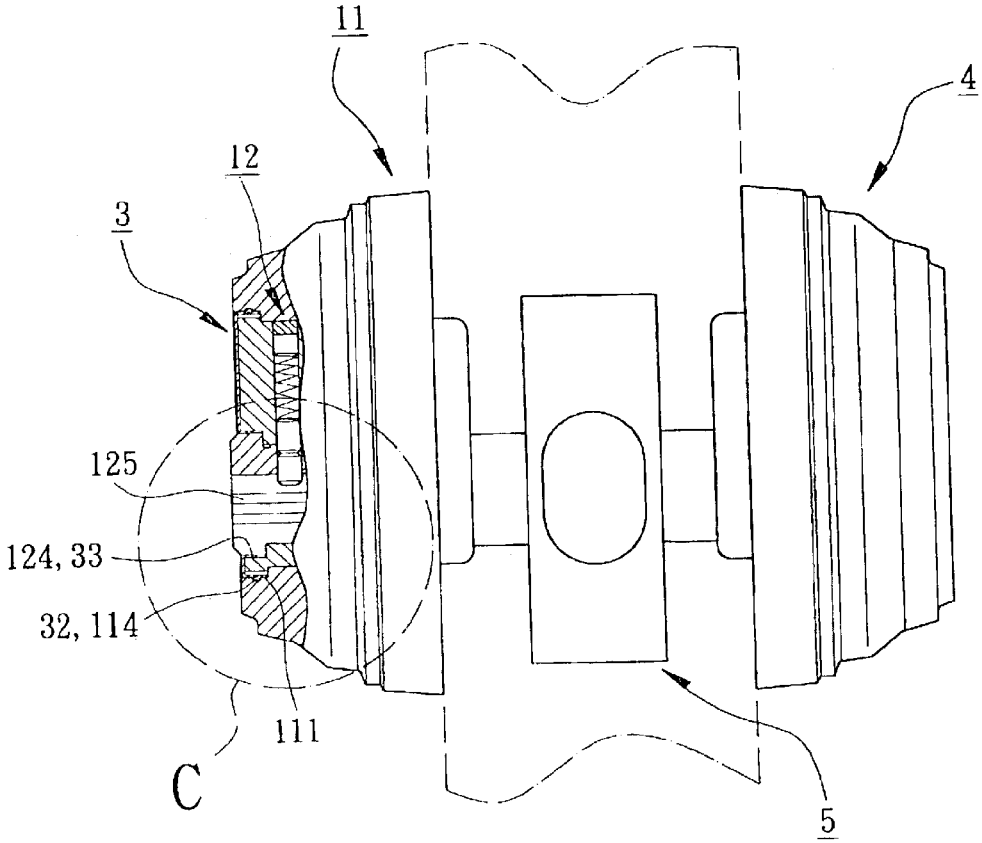
FIG. 7 is a cross sectional view of the lid device of a double-sided auxiliary lock of the second embodiment of the present invention.
Figure 8:
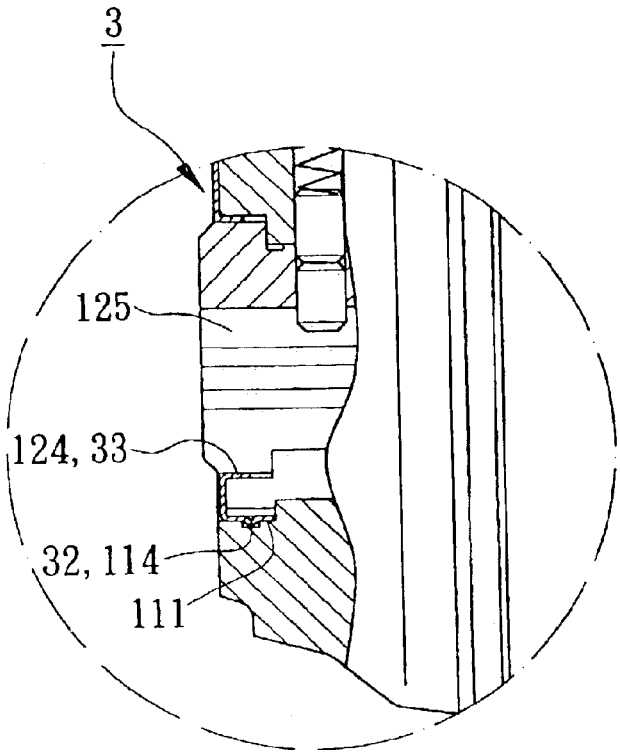
FIG. 8 is a partial enlarged view of the lid device of a double-sided auxiliary lock in the first preferred embodiment shown in FIG. 7.

Referring to FIG. 1, the lid device of a double-sided auxiliary lock of the first preferred embodiment of the present invention is illustrated. FIG. 2 shows the front view of the lid device of a double-sided auxiliary lock in the first preferred embodiment of the present invention. FIG. 3 is a cross sectional view showing the casing 11 in the first preferred embodiment of the present invention along a line A—A of FIG. 2. FIG. 4 is a partial enlarged view showing the detachment of the lid device of a double-sided auxiliary lock in the first preferred embodiment of the present invention. FIG. 5 is a partial enlarged view showing that the lid device of a double-sided auxiliary lock in the first preferred embodiment of the present invention has been detached. FIG. 6 shows the exploded perspective view of the lid device of a double-sided auxiliary lock in the second preferred embodiment of the present invention. FIG. 7 is a cross sectional view of the lid device of a double-sided auxiliary lock of the second embodiment of the present invention. FIG. 8 is a partial enlarged view of the lid device of a double-sided auxiliary lock in the first preferred embodiment shown in FIG. 7.

Referring to FIGS. 1 to 3, the double-sided auxiliary lock in the first preferred embodiment of the present invention includes an interior auxiliary lock 1, a plurality of positioning elements 2, a lid 3, an outer auxiliary lock assembly 4, and a latch assembly 5. The interior auxiliary lock assembly 1 includes a casing 11 and a locking core 12. The casing 11 is provided with a combining surface 111, an annular flange 112, and an opening 113. The combining surface 111 rests against the lid 3. In assembling the double-sided auxiliary lock of the present invention, the annular flange 112 is adapted to resist against the positioning locking core 12 for preventing the locking core 12 from release. The opening 113 is served to receive the locking core 12.

Referring to FIGS. 1 to 3, the locking core 12 includes an annular flange 121, a plurality of combining portions 122, a plurality of via holes 123, an inner annular groove 124 and a keyway 125. The annular flange 121 is served to locate the locking core 12 to be in the casing 11 and to engage the lid 3 to the locking core 12. An outer annular recess 126 is further formed in the annular flange 121. By the outer annular recess 126 with the combining portions 122, the lid 3 can be engaged with the annular flange 121 of the locking core 12. Each of the combining portions 122 is formed with a notch. When the lid 3 is combined with the outer annular recess 126 of the annular flange 121, the lid 3 is engaged with the combining portion 122. The via holes 123 are served to install the positioning elements 2 for screwing the latch assembly 5 and the outer auxiliary lock assembly 4. The inner annular groove 124 is communicated to the keyway 125. Thereby, a tool (not shown) can be inserted into inner annular groove 124 through the keyway 125 for disassembling operation so as to detach the lid 3 from the locking core 12. In this circumstance, the components of the double-sided auxiliary lock can be substituted. The keyway 125 can be inserted by a key (not shown) for driving the latch assembly 5 of the double-sided auxiliary lock.

Referring to FIG. 1 to 3, the lid 3 is served to cover the locking core 12 and the positioning elements 2. The lid 3 has an outer annular wall 31, a plurality of engaging portions 32, and an inner annular wall 33. The outer annular wall 31 is served to locate the lid 3 to the annular flange 121 of the locking core 12. The engaging portions 32 are equi-spaced on the outer annular wall 31. Preferably, the engaging portions 32 are elastic and thus in assembly the lid 3 to the locking core 12, it is only necessary to press the lid 3, so that the engaging portions 32, is deformed elastically to pass through the combining portions 122 of the locking core 12 and then engaged with the outer annular recess 126. Thereby, the lid 3 is engaged to the locking core 12. At least one engaging portion 32 of the lid 3 is correspondent to a position below the keyway 125 of the locking core 12. Thereby, as detaching the lid 3, the engaging portion 32 corresponding to the position below, the keyway 125 of the locking core 12 is initially disengaged from the outer annular recess 126. Then other engaging portions 32 are disengaged sequentially so as to prevent the engaging portions 32 from deformation due to improper twisting forces. As a result, the lid 3 can be detached conveniently. The inner annular wall 33 is correspondingly received in the inner annular groove 124 of the locking core 12. The inner annular wall 33 is exposed from one end of the keyway 125. Thus, the inner annular wall 33 can be hooked by using a tool, such as a clip. When the tool is used to extract the inner annular wall 33, the engaging portion 32 corresponding to the inner annular wall 33 is disengaged from the outer annular recess 126 and the combining portions 122 successively.

Referring to FIGS. 1 to 3 further, the outer auxiliary lock assembly 4 has a plurality of blind holes 41. The blind holes 41 are corresponding to the via holes 123 of the locking core 12. The latch assembly 5 is formed with a plurality of via holes 51 corresponding to the via holes 123 of the locking core 12 and the blind holes 41 of the outer auxiliary lock assembly 4. The locking core 12 is positioned to the blind holes 41 of the outer auxiliary lock assembly 4 by the positioning elements 2 to pass through via holes 123 and the via holes 51 of the latch assembly 5 and be screwed to the blind holes 41 of the outer auxiliary lock assembly 4 so as to assemble the double-sided auxiliary lock assembly.

Referring to FIGS. 4 and 5, if it is desired to detach the double-sided auxiliary lock of the present invention, a tool 6 is inserted into the keyway 125 of the locking core 12 and the inner annular groove 124 and connected with the inner annular wall 33 of the lid 3. Next, the tool 6 is used to extract the inner annular wall 33 of the lid 3 through the keyway 125 of the locking core 12. Therefore, the engaging portion 32 corresponding to the lower position of the keyway 125 may be disengaged from the outer annular recess 126 and the combining portions 122 of the locking core 12 so that the outer annular wall 31 can be removed from the annular flange 121 of the locking core 12. Thus, the lid 3 can be detached.

Referring to FIG. 6, the second preferred embodiment of the present invention is illustrated. It is: illustrated that the lid of the double-sided auxiliary lock in the second embodiment of the present invention is installed to a position for installing the lid of the double-sided auxiliary lock of first preferred embodiment. Thereby, the same elements of the two embodiments are designated by the same numerals so that the difference of the two embodiments will be easily understood. Those same parts in the first and second embodiments will not be described further.

Referring to FIGS. 6 and 8, the double-sided auxiliary lock of the present invention in the second embodiment includes an interior auxiliary lock assembly 1, a plurality of positioning elements 2, a lid 3, an outer auxiliary lock assembly 4, and a latch assembly 5. The interior auxiliary lock assembly 1 includes a casing 11 and a locking core 12. The casing 11 is provided with a combining surface 111, an annular flange 112, and an opening 113. As comparing with the first preferred embodiment, the combining surface 111 is further formed with an annular recess 114 for buckling the lid 3 to the casing 11. The annular flange 112 is radially extended inward. The opening 113 is served for receiving the locking core 12.

With reference to FIGS. 6 to 8, the locking core 12 includes an annular flange 121, a plurality of combining portions 122, a plurality of via holes 123, an inner annular groove 124 and a keyway 125. The annular flange 121 is served to locate the locking core 12 to resist against the annular flange 112 of the casing 11. Each combining portion 122 is formed with a notch. Each positioning element 2 is extended through the corresponding via hole 123.

With reference to FIGS. 6 to 8, the lid 3 includes outer annular walls 31 or wall sections (best seen in FIG. 6), engaging portions 32, and an inner annular wall 33. The outer annular wall 31 functions to locate the lid 3 to the annular flange 121 of the locking core 12. As compared with the first preferred embodiment, the engaging portions 32 are received in the annular recess 114 of the casing 11 of the locking core 12. The outer auxiliary lock assembly 4 has a plurality of blind holes 41. The latch assembly 5 has a plurality of via holes 51. The locking core 12 is positioned to the blind holes 41 of the outer auxiliary lock assembly 4 by the positioning elements 2 to pass through via holes 123 and the via holes 51 of the latch assembly 5 and be screwed to the blind holes 41 of the outer auxiliary lock assembly 4 so as to assemble the double-sided auxiliary lock assembly.

With reference to FIGS. 6 to 8, after the double-sided auxiliary lock is assembled, the outer annular wall 31 of the lid 3 is combined to a periphery of the annular flange 121 of the locking core 12 and resisted against the combining surface 111 of the casing 11. The engaging portions 32 are elastically buckled in the annular recess 114 of the casing 11 through the combining portions 122 of the locking core 12, and the inner annular wall 33 is inserted into the inner annular groove 124 of the locking core 12. Thereby, the lid 3 covers the positioning elements 2 on the surface of the locking core 12.

As mentioned above, the prior art positioning elements 2 of the interior auxiliary lock if a double-sided auxiliary lock is exposed. Not only the appearance of the double-sided auxiliary lock is affected, but also the positioning elements of the double-sided auxiliary lock will likely be destroyed by a burglar. However, the interior auxiliary lock assembly 1 of the double-sided auxiliary lock, shown in FIG. 1, in accordance with the present invention is added with a lid 3. At least one engaging portion 32 the lid 3 is arranged corresponding to a position below the keyway 125 of the locking core 12. Thus, the present invention is configured to resist destruction. Detaching the lid 3, may not result in its deformation and the detaching operation can be carried out conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lid device of a double-sided auxiliary lock comprising:

an outer annular wall arranged on the lid device;

a plurality of engaging portions installed on the outer annular wall, and at least one of the engaging portions is engaged with a position corresponding to a keyway of a locking core;

an inner annular wall corresponding to an inner annular groove of the locking core which is communicated with the keyway;

a casing is formed with an annular recess for engaging the engaging portions of the outer annular wall; and wherein when the lid device covers the locking core in assembly, the engaging portions are engaged with the casing.

2. The lid device of a double-sided auxiliary lock as claimed in claim 1, wherein the locking core has an annular flange for engaging with the outer annular wall.

3. The lid device of a double-sided auxiliary lock as claimed in claim 1, wherein the engaging portions are equi-spaced on the outer annular wall.

4. The lid device of a double-sided auxiliary lock as claimed in claim 1, wherein the locking core has a plurality of combining portions; when the engaging portions are combined with the casing, the combining portions provide space for allowing deformation of the engaging portions.

5. The lid device of a double-sided auxiliary lock as claimed in claim 1, wherein the engaging portions are elastic.

* * * * *